US005661811A

United States Patent [19]

Huemann et al.

[11] Patent Number: 5,661,811

[45] Date of Patent: Aug. 26, 1997

[54] REAR SEAT AUDIO CONTROL WITH MULTIPLE MEDIA

[75] Inventors: James Joseph Huemann, Noblesville; Raymundo Prieto, Kokomo, both of Ind.; Stuart Baker Sanders, Wheeling, Ill.

[73] Assignee: Delco Electronics Corporation, Kokomo, Ind.

[21] Appl. No.: 295,570

[22] Filed: Aug. 25, 1994

[51] Int. Cl.[6] ..... H04R 25/00

[52] U.S. Cl. ..... 381/25; 381/86

[58] Field of Search ..... 381/86, 74, 24–25, 381/123; 455/200.1, 355, 345, 353

[56] References Cited

U.S. PATENT DOCUMENTS

| | | | |
|---|---|---|---|
| 5,034,996 | 7/1991 | Carey et al. | 455/350 |
| 5,108,335 | 4/1992 | Carey et al. | 455/345 |
| 5,182,522 | 1/1993 | Paynting | 340/825.25 |
| 5,420,931 | 5/1995 | Donner | 381/86 |
| 5,526,434 | 6/1996 | Wakui | 381/123 |
| 5,546,273 | 8/1996 | Harris | 455/345 |

*Primary Examiner*—Edward L. Coles, Sr.
*Assistant Examiner*—Stephen Brinich
*Attorney, Agent, or Firm*—Jimmy L. Funke

[57] ABSTRACT

A microprocessor controlled automotive audio system with radio, cassette tape, and/or compact disk media has a rear seat control with headphones allowing rear passengers to turn off the rear speakers, turn on the headphones and select any media, while the front speakers play programs selected by a front control. Rear control of media programming is also permitted if the selected media is not under front control. Rear control signals the desired function to the microprocessor which executes the commands subject to front control dominance. An audio processor couples the front-selected program to front and rear outputs and to front speakers. An audio multiplexer connects any media as well as the rear output to the rear control where a speaker/headphone switch connects the multiplexer to the rear speaker or the headphone.

11 Claims, 2 Drawing Sheets

20
36
38
38
34
70
REAR SEAT CONTROLLER
56
Seek Up
Seek Down
66
68
Pscan Prog
Tape CD
64
Pwr
AM FM
62
60
54
FRONT AMP
18
REAR AMP
24
22
50
16
RF VOL
LF VOL
RR VOL
LR VOL
52
42
LOUDNESS
MUTE
BASS
TREBLE
44
46
48
40
MICROPROCESSOR
32
TUNER
TAPE
CD
R
L
R
L
R
L

REAR SEAT AUDIO CONTROL WITH MULTIPLE MEDIA

FIELD OF THE INVENTION

This invention relates to motor vehicle audio systems with multi-media program sources and particularly to such systems having rear seat control for selection of media.

BACKGROUND OF THE INVENTION

Automotive audio systems commonly are equipped with AM and FM tuning, cassette tape players, and compact disk players or changers so that a great variety of programming is available for listening by the vehicle occupants. It is also commonplace to equip such systems with front and rear speakers. Thus all the occupants listen to the same music or other program, even though they may have different preferences. It has been proposed to allow rear seat occupants to listen to headphones in the rear and to permit the programming to be selected by controls accessible to the rear occupants, and even allows the speakers to be turned off. However, giving control to the rear passengers does not resolve the difference in preferences but merely transfers the control from front to the rear. Moreover, driver assistance is required in turning on the headphones or turning off the radio while the headphones are playing.

SUMMARY OF THE INVENTION

It is therefore an object of the invention to permit the use of rear headphones to listen to a choice of selections while the front speakers play the same or another selection. Another object is to permit use of controls for rear headphones without driver intervention.

An automobile radio having front and rear speakers is equipped with a rear console for plugging in headphones, with separate volume controls, and disconnecting the rear speakers so the rear occupants can listen to the music or other fare on the rear portion of the audio system, without interruption of the front speakers. Controls in the rear are provided to select a medium other than that being played in front. Thus, if the driver is listening to the radio, the rear selection may be any available media, i.e., the radio, the cassette tape or the compact disc (CD). If the media choice is other than the one selected by the driver, then the rear controls can be used to seek other stations or advance to other selection, for example.

As in standard automotive radios, an AM/FM tuner, a cassette tape player and perhaps a CD player, are connected to an audio processor which selects one of the inputs, controls loudness, bass, treble, fade, etc. and supplies right and left output channels for both the front and the rear. The front channels are fed through a front amplifier to the front speakers. A multiplexer or switch has inputs from the tuner, the cassette player, and the CD player, if any, and the rear channels of the audio processor. The multiplexer output is fed through the rear amplifier and through a rear switch to either the rear speakers or the headphones. A microprocessor, subject to control signals from both the front seat control and the rear seat control, turns on the various media, controls both media selection switches and the rear switch to direct the rear output to speakers or headphones as commanded. The rear control has a power or on/off button to activate the rear control, an AM/FM button to choose the radio mode, Seek buttons for tuner control, programming buttons to select preprogrammed stations or selections, and a tape/CD button to toggle through the alternate media. The front control always has dominance when there is a conflict. If the tuner is selected by the front control, the rear may listen to the selected program but may not adjust the tuner. The rear control, however, does permit separate headphone volume control. Also the rear listener may choose the tape or CD; then the controls will permit a choice of selections.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE INVENTION

The ensuing description is directed to a motor vehicle audio system having at least two media, i.e., sources of music or other programs. Commonly, the sources are AM/FM radio or tuner (counted as one medium) and a cassette tape player, herein referred to as the tape player. CD players or CD changers are additional or alternative media which may be either remote units or integrated parts of the radio system. Traditionally these media are selected one at a time for playing over the vehicle speakers and the non-selected media are idle. In the system described here, two of the media may be operative at the same time, one being played over the front speakers (with rear speakers off) and the other being played over rear headphones and selectable by the rear seat occupants. Then the driver may listen to any program without restriction, sacrificing only the use of the rear speakers, and those using headphones in the rear may listen to the same selection or choose another medium without disturbing the driver either for assistance (except to load media) or by interrupting the front program. The vehicle ignition is shown as connected to the front control and to the microprocessor, symbolizing that the entire audio system is off when the ignition is off, although microprocessor memory may continue to be supplied with power.

Figure 1:
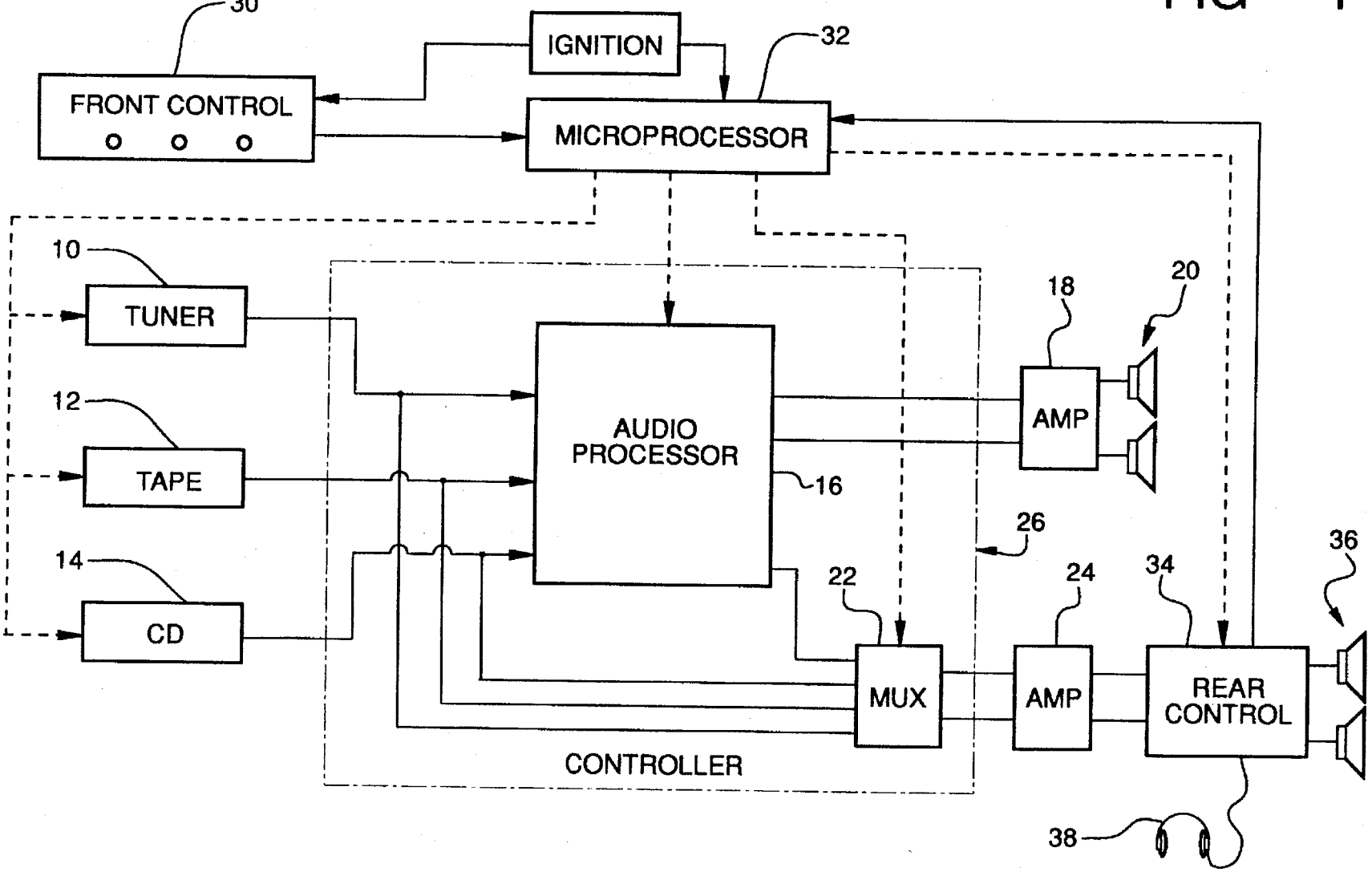
FIG. 1 is a block diagram of an automotive audio system with rear control according to the invention.

Referring to FIG. 1, an audio system for an automobile has a plurality of media comprising an AM/FM tuner 10, a tape player 12 and a CD player 14. Each of them is connected to an audio processor 16 which selects one medium, enhances the sound and outputs the sound on right and left front and rear channels. The front channel outputs are fed to a front amplifier 18 and front speakers 20. The rear channel outputs are fed to one input of a multiplexer 22 which has other inputs connected to each of the tuner 10, the tape player 12, and the CD player 14. The multiplexer output is coupled to a rear amplifier 24. The audio processor 16 and the multiplexer 22 together effect the media selection for front and rear channels and comprise a controller 26.

A front control 30 operable by the driver or front passenger has a full range of controls for turning system power on and off, selecting and controlling media, and for sound enhancement to obtain the desired loudness, treble, bass etc. Command signals are coupled from the control 30 to a microprocessor 32 which signals other parts of the system to carry out the commands. The system has a rear seat control 34 which has a limited range of control functions for media selection and control. Command signals are coupled from the rear control 34 to the microprocessor 32 to carry out those control functions, provided they are compatible with the commands from the front control. The rear control 34 is coupled to the rear amplifier 24 to receive the rear channel outputs, and selectively connects those outputs to rear speakers 36 or headphones 38.

The microprocessor 32 is programmed to carry out the commands of the front and rear controls, subject to the dominance of the front control over the rear. Essentially, to the extent that it responds to the front control 30, the microprocessor management of the system is already known for commercially available radio systems. It is coupled to the tuner 10, the tape player 12 and the CD player 14 to turn any of them on or off, select mode of operation, e.g. AM or FM, select stations or tape programs, etc. It is coupled to the audio processor 16 to select one of the media and adjust the loudness, fade, balance, etc. The rear control imposes added duties on the microprocessor 32; it must control the multiplexer 22 to select a rear channel source and control the channel switching in the rear control 34.

Figure 2:
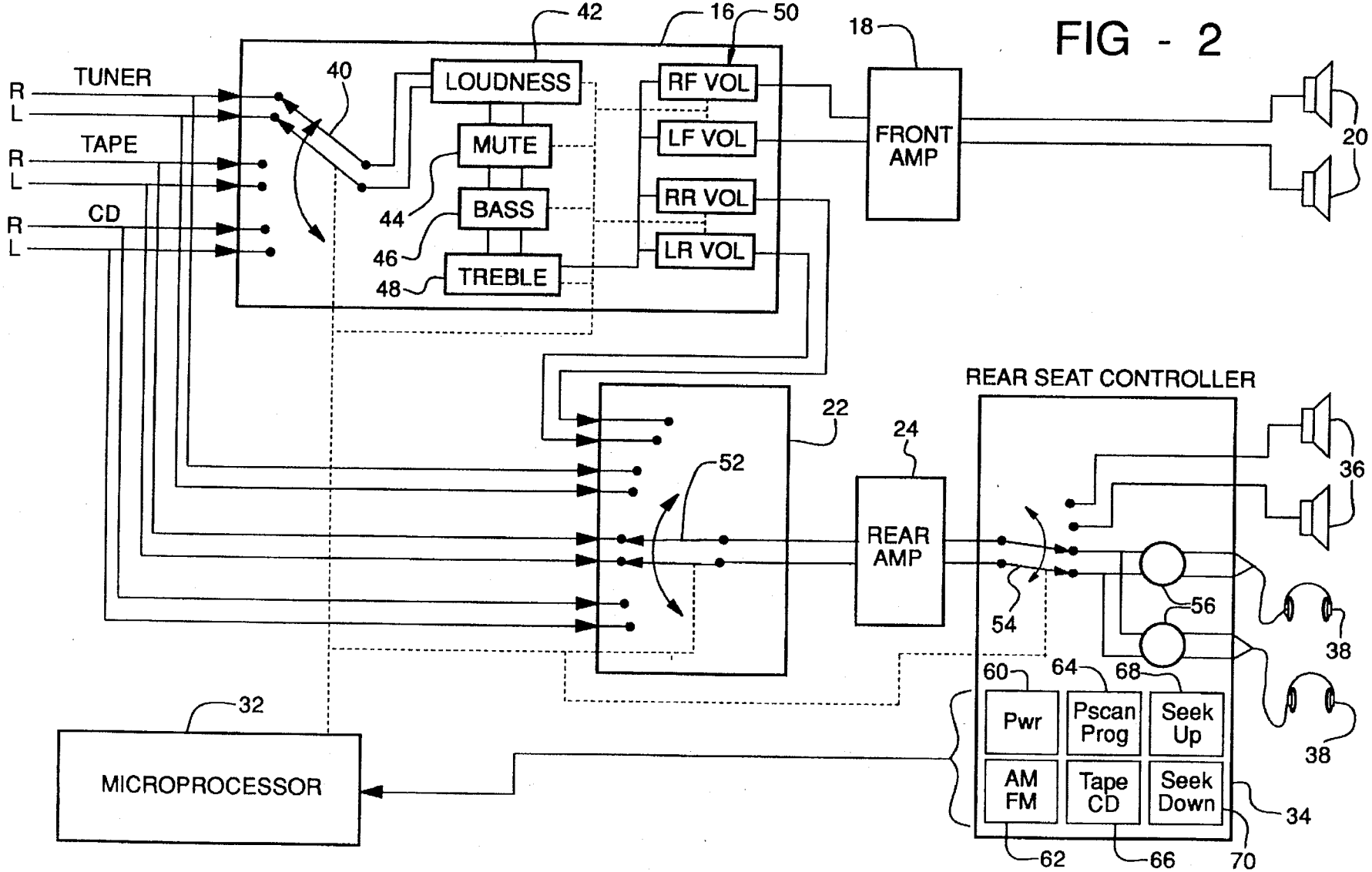
FIG. 2 is a block diagram of a portion of the FIG. 1 diagram in greater detail.

FIG. 2 comprises a portion of FIG. 1 but in greater detail. The audio processor 16 includes a switch 40 under microprocessor 32 control for selecting one of the media. The selected input is routed through sound enhancement stages including loudness 42, mute 44, bass 46, treble 48 and individual channel volume controls 50 which determine balance and fade; each stage is under microprocessor control. The multiplexer 24 includes a switch 52 under microprocessor control for connecting dual channels from each of the media and from the rear output of the audio processor 16 to the rear control 34 via the rear amplifier 24.

The rear control 34 includes a speaker/headphone switch 54 under microprocessor control for selectively connecting the rear amplifier 24 output to the rear speakers 36 or to headphones 38. A volume control 56 is provided for each headphone. Six control buttons on the rear control 34 operate switches to send command signals to the microprocessor. The signals are analog voltages developed in a well-known manner by a matrix of resistors and the control switches so that a particular voltage level is selected by each button. An analog-to-digital converter in the microprocessor issues a unique digital command signal in response to each analog signal to carry out the desired function.

The six control buttons are Power 60, AM/FM 62, P.Set Prog 64, Tape/CD 66, Seek Up 68 and Seek Down 70. The microprocessor is programmed to initialize and to respond to the button operation as follows: When the vehicle ignition is first turned on, the system will default to full front control and the rear control is off; all speakers are turned on if the front control is on. Full front control with all speakers on is also obtained if the front power is turned off and then on again within two seconds. Power button 60 turns the control and the headphones 38 on, the rear speakers 36 off, and vice versa. As shown in TABLE 1, the AM/FM button 62 selects the tuner and toggles between the available AM and FM bands. The P.Set Prog button 64 in radio mode seeks preset stations; in tape mode, it changes tape side; in CD changer mode, it seeks next CD. The Tape/CD button 66 selects the tape source and CD source upon sequential button operation. The Seek Up button 68 and Seek Down button 70, in radio mode seek stations; in tape mode, seek the previous/next function; and in CD mode, seek the previous/next track function.

TABLE 1

| REAR FUNCTION | RADIO | TAPE | CD |
|---|---|---|---|
| Seek Up | Seek Up | Next | Next |
| Seek Down | Seek Down | Previous | Previous |
| P. Set Prog | Preset | Change Side | Change Disk |
| AM/FM | AM/FM1/FM2 | To Radio | To Radio |
| Tape/CD | To Tape | To CD | To Tape |
| Power | {Activate Headphones, Turn Off Rear Speaker} | | |

Overriding all the above functions is the provision in the microprocessor programming that when a medium is selected by the front control, the rear control may select the same medium for listening, but it may not exercise any control over that medium. This algorithm is illustrated in TABLE 2 which includes tuner and tape media for illustration but can easily be extended to CD as well. If the front control has selected the tuner, the rear control may not control the tuner but it can control the tape. Similarly, if the front control has selected the tape, the rear control may not control the tape but it can control the tuner. If the front control is off, there is no restriction on the rear controls.

TABLE 2

| | REAR MODE | | | |
|---|---|---|---|---|
| FRONT MODE | Tuner Select | Tape Select | Tuner Control | Tape Control |
| Tuner | Yes | Yes | No | Yes |
| Tape | Yes | Yes | Yes | No |
| Off | Yes | Yes | Yes | Yes |

It will thus be apparent that the rear control function may be effected at low cost by adding the multiplexer 22, the rear control 34 and headphones 38 to a commercial automotive audio system. An alteration in the microprocessor programming is easily carried out to assure that the front control has dominance and that otherwise the rear control may freely exercise media selection and program selection functions without intervention by the driver.

The embodiments of the invention in which an exclusive property or privilege is claimed are defined as follows:

1. In an audio system for a motor vehicle having a plurality of media, front and rear speakers, rear head phones and both front and rear user controls, control means comprising:

a microprocessor;

a front user control supplying inputs to the microprocessor;

a rear user control supplying inputs to the microprocessor, the rear user control having media programming buttons for sending rear control commands to the microprocessor for controlling a medium selected by the rear control;

a controller subject to the microprocessor having;

inputs from each media, a first switch means for selecting a media input in accordance with front control inputs for coupling to the front speakers, and a second switch means for selecting a media input in accordance with rear control inputs for selective coupling to rear speakers and headphones; and means including the microprocessor for asserting dominance of the front control inputs when there is a conflict of front and rear control inputs wherein the microprocessor is programmed to carry out the rear control commands only when the medium is not also currently selected by the front user control, and when the front speakers are coupled to one of the media as selected by the front user control, the headphones may be coupled to another of the media as selected by the rear user control.

2. The invention as defined in claim 1 wherein:

the rear control having media programming buttons for sending control commands to the microprocessor for controlling a medium selected by the rear control;

the microprocessor being programmed to carry out the control commands only when the medium is not also currently selected by the front user control.

3. In an audio system for a motor vehicle having a plurality of media, front and rear speakers, rear head phones and both front and rear user controls, control means comprising:

a microprocessor;

a front user control supplying inputs to the microprocessor;

a rear user control supplying inputs to the microprocessor, the rear user control having media programming buttons for sending control commands to the microprocessor for controlling a medium selected by the rear control;

a controller subject to the microprocessor having;

inputs from each media, a first switch means for selecting a media input in accordance with front control inputs for coupling to the front speakers, and a second switch means for selecting a media input in accordance with rear control inputs for selective coupling to rear speakers and headphones;

wherein the microprocessor is programmed to carry out the control commands only when the medium is not also currently selected by the front user control, and when the front speakers are coupled to one of the media as selected by the front user control, the headphones may be coupled to another of the media as selected by the rear user control; and wherein the rear user control further includes a speaker/headphone switch subject to the microprocessor for selectively coupling the second switch to the speakers and headphones.

4. In an audio system for a motor vehicle having a plurality of media, front and rear speakers, rear head phones and both front and rear user controls, control means comprising:

a microprocessor;

a front user control supplying inputs to the microprocessor;

a rear user control supplying inputs to the microprocessor, the rear user control having media programming buttons for sending control commands to the microprocessor for controlling a medium selected by the rear control;

a controller subject to the microprocessor having;

inputs from each media, a first switch means for selecting a media input in accordance with front control inputs for coupling to the front speakers, and a second switch means for selecting a media input in accordance with rear control inputs for selective coupling to rear speakers and headphones;

wherein the microprocessor is programmed to carry out the control commands only when the medium is not also currently selected by the front user control, and when the front speakers are coupled to one of the media as selected by the front user control, the headphones may be coupled to another of the media as selected by the rear user control; and wherein:

the second switch means comprises a multiplexer having an output and a plurality of inputs connected to each of the media and to the first switch means; and a speaker/headphone switch is coupled to the output of the multiplexer for selecting either of the rear speakers and headphones.

5. In an audio system for a motor vehicle having a plurality of media, front and rear speakers, rear head phones and both front and rear user controls, control means comprising:

a microprocessor;

a front user control supplying inputs to the microprocessor;

a rear user control supplying inputs to the microprocessor, the rear user control having media programming buttons for sending control commands to the microprocessor for controlling a medium selected by the rear control;

a controller subject to the microprocessor having;

inputs from each media, a first switch means for selecting a media input in accordance with front control inputs for coupling to the front speakers, and a second switch means for selecting a media input in accordance with rear control inputs for selective coupling to rear speakers and headphones;

wherein the microprocessor is programmed to carry out the control commands only when the medium is not also currently selected by the front user control, and when the front speakers are coupled to one of the media as selected by the front user control, the headphones may be coupled to another of the media as selected by the rear user control, the system further including:

an audio processor coupling the first switch to the front speakers and to a rear audio output;

the second switch means comprises a multiplexer having an output and a plurality of inputs connected to each of the media and to the rear audio output; and a speaker/headphone switch is coupled to the output of the multiplexer for selecting either of the rear speakers and headphones.

6. The invention as defined in claim 5 including means for turning off the rear control; and means including the multiplexer and the speaker/headphone switch for coupling the rear audio output to the rear speakers when the rear control is off.

7. The invention as defined in claim 5 including means for turning the rear control on and off; and means including the multiplexer and the speaker/headphone switch for coupling one of the media to the headphones when the rear control is turned on.

8. In an audio system for a motor vehicle having a plurality of media, front and rear speakers, rear head phones and both front and rear user controls, control means comprising:

a microprocessor;

a front user control supplying inputs to the microprocessor;

a rear user control supplying inputs to the microprocessor, the rear user control having media programming buttons for sending control commands to the microprocessor for controlling a medium selected by the rear control;

a controller subject to the microprocessor having;

inputs from each media, a first switch means for selecting a media input in accordance with front control inputs for coupling to the front speakers, and a second switch means for selecting a media input in accordance with rear control inputs for selective coupling to rear speakers and headphones;

wherein the microprocessor is programmed to carry out the control commands only when the medium is not also currently selected by the front user control, and when the front speakers are coupled to one of the media as selected by the front user control, the headphones may be coupled to another of the media as selected by the rear user control; the system further including:

an audio processor coupling the first switch to a front audio output and to a rear audio output;

a front amplifier coupling the front audio output to the front speakers;

the second switch means comprises a multiplexer having an output and a plurality of inputs connected to each of the media and to the rear audio output;

a rear amplifier coupled to the multiplexer output; and a speaker/headphone switch is coupled to the rear amplifier for selecting either of the rear speakers and headphones.

9. In an audio system for a motor vehicle having a plurality of media, front and rear speakers, rear head phones and both front and rear user controls, control means comprising:

a microprocessor;

a front user control supplying inputs to the microprocessor;

a rear user control supplying inputs to the microprocessor, the rear user control having media programming buttons for sending control commands to the microprocessor for controlling a medium selected by the rear control;

a controller subject to the microprocessor having;

inputs from each media, a first switch means for selecting a media input in accordance with front control inputs for coupling to the front speakers, and a second switch means for selecting a media input in accordance with rear control inputs for selective coupling to rear speakers and headphones;

wherein the microprocessor is programmed to carry out the control commands only when the medium is not also currently selected by the front user control, and when the front speakers are coupled to one of the media as selected by the front user control, the headphones may be coupled to another of the media as selected by the rear user control; and wherein:

the rear control includes media selection switches for sending selection signals to the microprocessor;

the microprocessor being programmed to couple the selected media to the headphones irrespective of the media selected by the front control.

10. In an audio system for a motor vehicle having a plurality of media, front and rear speakers, rear head phones and both front and rear user controls, control means comprising:

a microprocessor;

a front user control supplying inputs to the microprocessor;

a rear user control supplying inputs to the microprocessor;

a controller subject to the microprocessor having;

inputs from each media, a first switch means for selecting a media input in accordance with front control inputs for coupling to the front speakers, and a second switch means for selecting a media input in accordance with rear control inputs for selective coupling to rear speakers and headphones; and means including the microprocessor responsive to the vehicle ignition for turning off the rear control when the vehicle ignition is just turned on;

wherein when the front speakers are coupled to one of the media as selected by the front user control, the headphones may be coupled to another of the media as selected by the rear user control and the microprocessor is programmed to initialize the system to turn off the rear control when vehicle ignition is just turned on.

11. In an audio system for a motor vehicle having a plurality of media, front and rear speakers, rear head phones and both front and rear user controls, control means comprising:

a microprocessor;

a front user control supplying inputs to the microprocessor;

a rear user control supplying inputs to the microprocessor; and a controller subject to the microprocessor having;

inputs from each media, a first switch means for selecting a media input in accordance with front control inputs for coupling to the front speakers, and a second switch means for selecting a media input in accordance with rear control inputs for selective coupling to rear speakers and headphones;

wherein when the front speakers are coupled to one of the media as selected by the front user control; and means responsive to the front control and the vehicle ignition and including the microprocessor for asserting dominance of the front control inputs by initializing the system the vehicle ignition is just turned on to turn off the rear control and to turn on the rear speakers when the front control is on.

* * * * *